United States Patent [19]

Keeble

[11] 4,295,650

[45] Oct. 20, 1981

[54] SURFACE PROJECTILE GAME WITH MALLETS AND THREE-SIDED TARGETS

[76] Inventor: Joseph D. Keeble, 17829 Lazy Dog Rd., Nevada City, Calif. 95959

[21] Appl. No.: 137,719

[22] Filed: Apr. 7, 1980

[51] Int. Cl.[3] ..... A63B 71/02; A63B 59/10

[52] U.S. Cl. ..... 273/118 R; 273/56; 273/83; 273/127 B

[58] Field of Search ..... 273/56, 57, 83, 118 R, 273/127 R, 127 B, 176 AA, 129 E

[56] References Cited

U.S. PATENT DOCUMENTS

| | | | |
|---|---|---|---|
| 1,166,946 | 1/1916 | Taylor | 273/83 |
| 1,587,295 | 6/1926 | Gammeter | 273/176 AA |
| 2,583,493 | 1/1952 | Prentice et al. | 273/118 R X |
| 2,849,238 | 8/1958 | Eldridge | 273/127 B X |

FOREIGN PATENT DOCUMENTS

| | | | |
|---|---|---|---|
| 22307 | of 1897 | United Kingdom | 273/127 R |

*Primary Examiner*—Anton O. Oechsle
*Attorney, Agent, or Firm*—Huebner & Worrel

[57] ABSTRACT

A system for use by at least one player-contestant characterized by a ball, a plurality of portable, three-sided targets adapted to be positioned in a mutually spaced relationship on a playing surface for designing the course, each of the targets being characterized by a pair of adjacently related portals arranged in horizontally converging planes and suitably dimensioned for accommodating a passage of the ball therethrough; and at least one mallet for accommodating a striking of the ball by a player-contestant for propelling the ball in rolling motion along the playing surface and through the portals, said mallet being characterized by an elongated head and a handle projected perpendicularly from the head for accommodating a grasping of the end portion thereof, the ends of said head being characterized by a planar surface of an area less than the cross-sectional area of the mallet head, whereby free swinging of the mallet is accommodated.

1 Claim, 8 Drawing Figures

18
20
26
26

24

32
30
6
26

32
20
6
18
54
46
38
48
50
42
54
54
36
40
44
54
17
52
54
34

5
10
24
4
17
6
3
2
24
17
10
1

12
16
1
14
10

SURFACE PROJECTILE GAME WITH MALLETS AND THREE-SIDED TARGETS

BACKGROUND OF THE INVENTION

1. Field of the Invention

The invention generally relates to a system which includes a ball, a plurality of mallets, a plurality of threesided targets, and more particularly to a new system which provides for golf-like excitement in a backyard environment, and one which can be utilized on a playing surface of substantially any shape, size, or slope for amusement purposes.

2. Description of the Prior Art

For many years, the game of golf has been enjoyed by young and old alike. Unfortunately, golf requires a course laidout over relatively large acreages. Today, because of competing interests, many golf courses are being subdivided for housing. Further, golf greens are relatively expensive to develop and maintain. Moreover, not only are golf courses expensive to develop and maintain, but as can be appreciated by most golf enthusiasts, the game requires substantial amounts of skill before it can be played with enjoyment.

In an effort to overcome various undesirable consequences which attend the playing of the game of golf, miniature golf courses have been developed and played with varying levels of excitement and enjoyment being experienced by the participants. However, miniature golf courses also tend to require an investment of substantial amounts of capital and often simply are not conveniently available to potential users.

Another sport, or game, often enjoyed is the game identified as croquet. Unfortunately, participation in this sport is not entirely rewarding since its play requires that a substantial area of open space be provided for the required course. Unfortunately, generally speaking, a suitable level of excitement fails to attend the play of croquet, consequently, in many instances the game is simply avoided.

It should now be apparent that there currently exists a need for a system which can be utilized in a sport as for playing a game having increased player appeal.

It is, therefore, the purpose of the instant invention to provide a system which can be utilized for a playing area of substantially any shape, size or slope and through a use of which player-contestants may experience golf-like excitement, in a backyard environment, and be enjoyed by player-contestants regardless of the level of skill attained by the contestant.

OBJECTS AND SUMMARY OF THE INVENTION

It is an object of the instant invention to provide a system for use by at least one player-contestant.

It is another object to provide an amusement system for use in the playing of a game having characteristics similar in certain respect to those of the game of golf, but one which may be played more conveniently, economically and with lesser degrees of skill.

These and other objects and advantages are achieved through the use of a system which includes a ball, plurality of portable, three-sided targets adapted to be positioned in a mutually spaced relationship on a playing surface for defining a course, each of said targets being characterized by a pair of adjacently related portals, said portals being arranged in horizontally converging planes and suitably dimensioned for accommodating a passage of said ball therethrough, and at least one mallet for accommodating a striking of the ball by player-contestants for propelling the ball in rolling motion along the surface, said mallet being so configured as to accommodate a swing thereof through an arc of at least 90°, preparatory to striking the ball.

DESCRIPTION OF THE PREFERRED EMBODIMENT

At the outset, it is to be understood that the system embodying the principles of the instant invention includes unique hardware, and that this hardware is to be used in the playing of a unique game. Consequently, it is believed that a glossary of terms relating to the system, as well as the sport or the game played employing the system, may serve to provide a more complete understanding of the invention. Accordingly, the following glossary is provided:

CROFE—a combination of the terms "croquet" and "golf" used to identify a game to be played employing the system of the invention.

MARKER—a numbered directional sign used to locate the marker zone and show the general direction of the tricket.

MARKET ZONE—the generally accepted arem from which the first shot on each crofepath is put into play.

CROFEPATH—the course segments or inbounds area lying between a markerzone and its related tricket.

TRICKET—a three-sided wire target.

PORTALS—two scoring sides for a tricket.

NORTAL—a non-scoring side for a tricket.

FAIRTRIK—a scoring shot by virtue of a struck ball having passed through one of the portals.

ROUND—the playing of all crofepaths and the final scoring of fairtriks comprise a round.

SPOTTING—to mark and remove a ball, by request.

MALLET LENGTH—the longest dimensions for a mallet, including its shaft.

MALLET HEAD LENGTH—the longest distance for a mallet head.

LEAD ARM—the tricket leg between two portals.

TRIKED—when the ball comes to rest against one of the legs of a tricket.

Figures 1, 8:
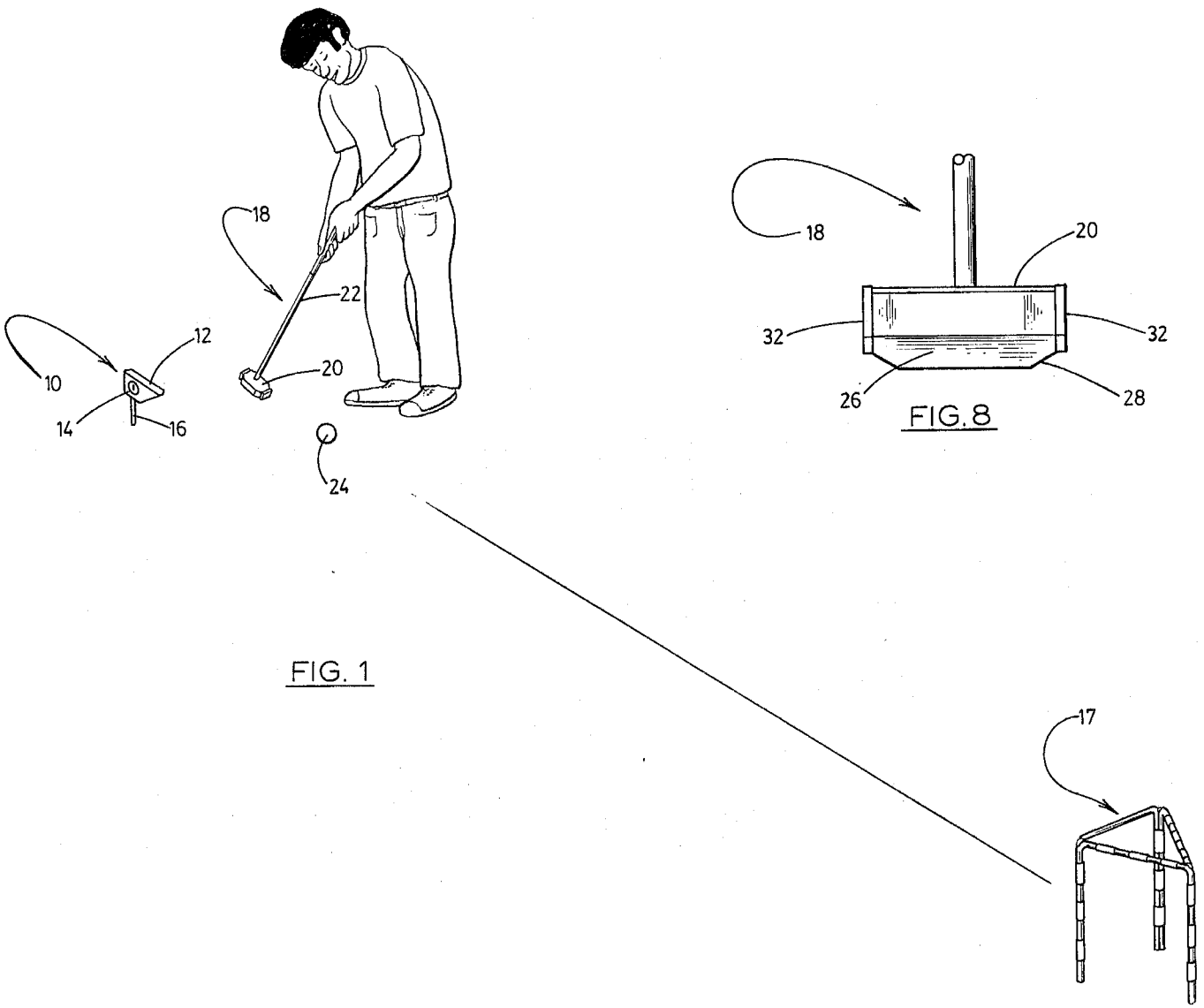
FIG. 1 is a pictorial view depicting a use of a system which embodies the principles of the instant invention.
FIG. 8 is a fragmented side view of the mallet shown in FIG. 5.

Turning now to FIG. 1, there is shown a player-contestant engaged in a game, identified as Crofe, utilizing the system of the instant invention.

The system includes a marker 10, preferably formed of a wood block 12 bearing identification indicia 14. The block 12 is mounted on a stake 16 so configured as to accommodate its insertion into the ground. Preferably, the indicia 14 serves to indicate a crofepath, by number, while the block 12 is so shaped as to point toward a target, or in the general direction of a tricket, designated 17.

The system also includes a plurality of similar mallets generally designated 18, one being shown for exemplary purposes. Each of the mallets is characterized by a head 20 and a handle 22 projected from the head. It is noted that the mallet 18 is so designed as to accommodate a striking of a ball, generally designated 24, to be driven or rolled along a playing surface toward a target or tricket 17. It also is important to note that the handle 22 is of a length such as to accommodate a "full swing" of the mallet head preparatory to a striking of the ball 24. In practice, a "full swing" requires a swinging of the head 20 through an arc of a length of at least 90°. However, the mallet may be swung in a longer arc, where distances from the marker 10 to its related tricket 17 is such as to require application of even a greater striking force to the ball 24. Similarly, the arc may be of a lesser length, as will hereinafter be more fully discussed.

Referring to a moment to FIGS. 5, 6, 7 and 8, it is important to note that the head 20 of the mallet 18 is generally elongated and is formed from a rectangular block having beveled edges for imparting to the head a cross-sectional area substantially half-round in shape. The beveled edges form surfaces 26 which extend along the lowermost edge portions of the head, as well as surfaces 28 which extend across the lowermost end surfaces from the head. As should now be apparent, the surfaces 26 and 28 are formed by a removal of material which would otherwise impede a pendulous swing of the mallet, particularly where the mallet is swung with a substantial force, as it is applied through the arms and hands of a player-contestant.

Additionally, each of the opposite ends of the mallet 18 is provided with a transverse planar striking surface 30. Preferably, these surfaces comprise the outermost surfaces of striking pads 32 affixed to the opposite ends of the mallet head for accommodating a striking of the ball 24. However, the pad 32 is omitted as desired.

Figures 2, 3, 4, 5, 6, 7:
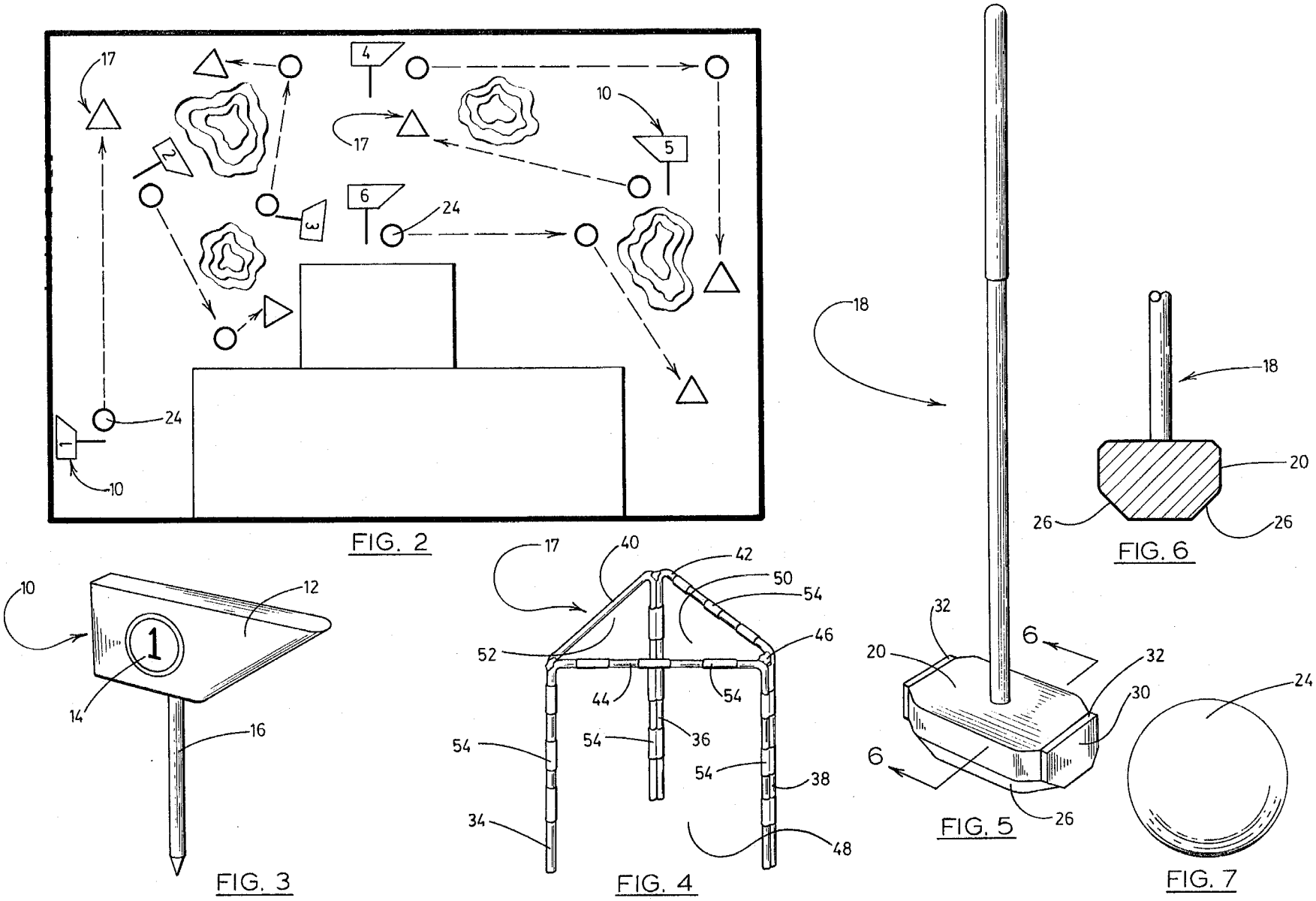
FIG. 2 is a pictorial view of a course laid-out for the use of the system embodying the principles of the instant invention.
FIG. 3 is a perspective view of one of a plurality of similar markers included in the system.
FIG. 4 is a perspective view of a three-sided target comprising one of a plurality of such targets included in the system.
FIG. 5 is a perspective view of one of a plurality of mallets included in the system.
FIG. 6 is a cross-sectional view taken generally along lines 6—6 of FIG. 5.
FIG. 7 is a view of a ball included in the system.

Turning now to FIGS. 1 and 4, it can be seen that the tricket 17 is provided with three legs, designated 34, 36, and 38, arranged in mutually spaced parallelism and interconnected at their adjacent ends by a plurality of horizontally extended arms 40, 42, and 44. Preferably, the arms 40, 42, and 44 are united with each other through a use of suitable fasteners such as welds 46 and the like.

At this juncture, it also is important to note that, as shown, the legs 34 and 38 are interconnected through the arm 44, and thus define a first opening or portal, designated 48. The legs 36 and 38, however, are interconnected through the arm 42 and thus define a second portal, designated 50. Finally, the legs 34 and 36, interconnected through the arm 40 define a nortal, designated 52. The portals 48 and 50 are identified by banding, designated 54, while the arm 40, which defines the top of the nortal 52 is left plain. Consequently, the nortals and portals are clearly marked and, accordingly, are easily identified for aiding in the use of the system, according to established rules provided for the playing of the game.

It is believed that in view of the foregoing description, the use of the system herein disclosed and claimed readily is apparent, however, in the interest of completeness, a description of its use in the playing of a game is, at this point, briefly set forth.

The rules of play require that the ball 24 be moved only by the force of the mallet 18, which force is applied as a result of a swing having a backward arc equal to or greater than one mallet head length. The ball 24 is addressed from any position so long as it is struck in the manner aforementioned. Moreover, contact must be made with the ball only at a striking surface 30. A stroke is counted if the ball 24 is moved, whether struck intentionally or not.

A player, of course, may be required to spot his ball, upon request, however, should a player fail to request a spot of an opponent's ball resulting in a collision of two or more balls, the following remedies are available:

A. The player whose mallet put the balls in motion must play its next shot from where the ball lies and, a one-shot penalty is imposed for failure to request a spot of the opponent's ball;

B. A player whose ball is moved as a result of impact by a ball, rather than from being struck by a mallet, has an option of playing its next shot from where its ball lies or returning the ball to its original position.

Any ball mistakingly hit by another player is returned to its original position. A fairtrik is scored by virtue of a ball being caused to advance through a portal in response to being struck by a mallet; a ball caused to advance through a portal in response to being struck by the ball of another contestant does not result in a score, a ball thus struck must be played in the manner aforedescribed.

To score, a player-contestant's ball must break the plane on the portal side of a tricket 17. To break the plane, the ball must either stop inside the tricket or pass completely therethrough. A ball that rolls partially inside the tricket, stops and then rolls backwardly out of the tricket, does not result in a score; a ball may pass through a nortal of a tricket without a penalty; a ball which passes through a nortal out a portal, stops and rolls back through the portal results in a fairtrik, or score.

A ball entering a tricket 17 through a nortal 52, then stopping within the tricket, is returned to the point from which it came, and the player striking the ball is penalized one shot, but is allowed to strike the ball again. As a penalty for driving the ball out-of-bounds, a player-contestant is penalized one stroke, with the ball being returned to play in the following manner:

1. Stand one mallet length in bounds, but no closer to the target, at the point where the ball exited;
2. Facing in the general direction of the target, or tricket, the ball is dropped by the player-contestant from the point behind his head and, should the ball contact the player's body or roll closer to the tricket, the drop must be repeated. However, after the third drop, no further drop is allowed and the ball is placed one mallet length in-bounds, but no closer to the target, or tricket.

It is important to fully appreciate that the rules can be varied as required, but above all, courtesy and fair play is necessitated.

As a matter of convenience for purposes of more fully illustrating the use of the system, reference is made to FIG. 2. It is here noted that the markers 10 and trickets 17 are so positioned as to define segments, not designated, of a course, or crofepath defined by six trickets. Of course, the number of trickets employed is varied as desired, depending upon such factors as available space, the shape of the playing area and the nature of the obstacles within the defined crofepaths.

Finally, the routine of play is as follows:

The starting order for the first tricket is determined; each player in turn, strikes a ball from the first marker zone; on the second and each successive shot, the closest to the target tricket shoots first until all players have a fairtrik; on the second and subsequent trickets, players shoot in the order of finish of the previous tricket, beginning with the player who took the most strokes or shots and ending with the player who took the least; after the first shot, play continues in the manner as aforedescribed. When all six trickets, as shown, have been played in the same manner the round is over and the player-contestant having the lowest total score is considered the winner. Of course, in the case of a tie, the tied players return to the marker zone #1 and play "sudden death".

In view of the foregoing, it is believed to be apparent that the amusement system herein described and claimed provides for the play of a new game or sport having wide-spread appeal to contestants of varying levels of skill.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. An amusement system for a plurality of player-contestants comprising:

A. a ball of a dimension suitable to permit the ball to be struck by a mallet, when positioned on a playing surface and propelled in rolling motion along segments of a course defined on said surface;

B. a plurality of portable, unitary three-sided targets adapted to be positioned on said playing surface in mutually spaced relation for dividing said surface into mutually spaced course segments, each of said targets being characterized by three legs of a substantially common length arranged in mutually spaced parallelism defining a pair of adjacent portals arranged in a pair of horizontally converging planes for accommodating passage of the ball, said legs being interconnected by three arms horizontally extended between adjacent ends of the legs and welded thereto;

C. a plurality of course markers, each marker being adapted to be positioned in spaced relation with one target of said plurality for indicating a segment of said course; and D. a plurality of mallets for use by said player-contestants, each mallet being characterized by an elongated head and a handle projected perpendicularly from the head, having defined at each of its opposite ends a planar striking surface of an area less than the cross-sectional area of the head and having a resilient covering affixed thereto, said head being tapered at its ends along three sides and said cross-sectional area being substantially of a half-round shape, with the curvature thereof being oppositely related to the handle, and said handle being of a length sufficient to permit a contestant to grasp the end portion of the handle opposite head and swing the head through an area having a length of at least 90°.

* * * * *